United States Patent [19]

Zide

[11] 4,370,759

[45] Feb. 1, 1983

[54] FACE GUARD MOUNT FOR HELMETS

[75] Inventor: Robert Zide, Williamstown, W. Va.

[73] Assignee: Pro-Line, Inc., Marietta, Ohio

[21] Appl. No.: 244,710

[22] Filed: Mar. 17, 1981

[51] Int. Cl.[3] ..... A42B 1/08

[52] U.S. Cl. ..... 2/424; 2/9

[58] Field of Search ..... 2/9, 424, 425, 411, 2/412, 413, 414, 10

[56] References Cited

U.S. PATENT DOCUMENTS

| | | | |
|---|---|---|---|
| 3,787,895 | 1/1974 | Belvedere | 2/9 |
| 4,042,974 | 8/1977 | Morgan et al. | 2/9 |
| 4,086,664 | 5/1978 | Humphrey et al. | 2/9 |
| 4,271,537 | 6/1981 | Bowlus et al. | 2/9 X |

*Primary Examiner*—Peter P. Nerbun

*Attorney, Agent, or Firm*—Brady, O'Boyle & Gates

[57] ABSTRACT

Shock absorbing mounts for the face guard of a helmet having a substantially rigid shell and being connected to the shell allow substantial movements of the face guard relative to the helmet shell in response to forceful blows on the face guard. The mount protects the head of the wearer of the helmet from severe shocks and also prevents severe deformation of the helmet shell likely to crack it. The mount can be installed at all points of attachment of the face guard to the helmet to provide a resilient anchorage for the face guard without loss of security.

15 Claims, 8 Drawing Figures

FIG.5
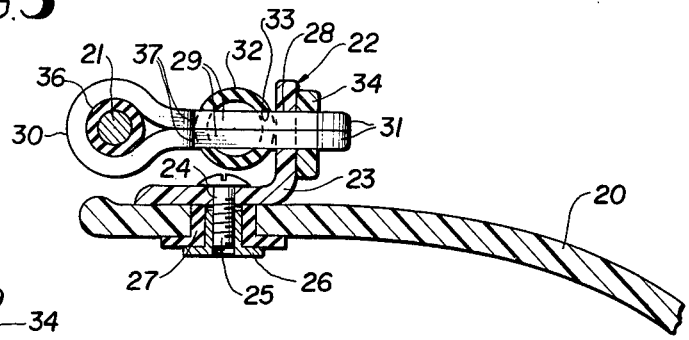
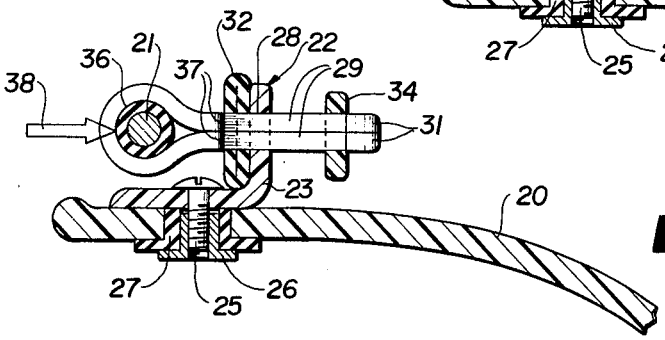
FIG.6
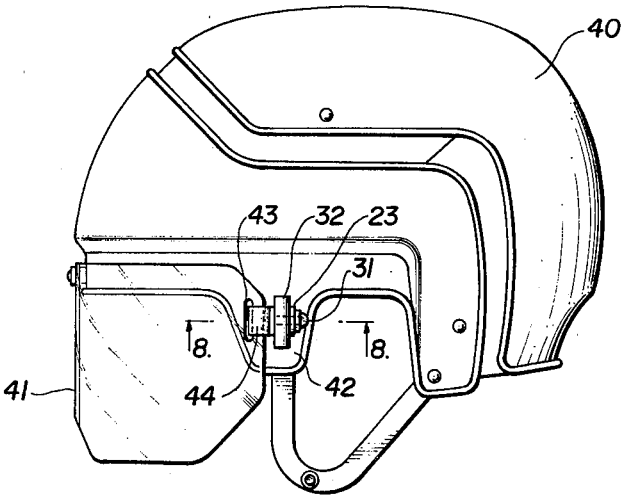
FIG.7
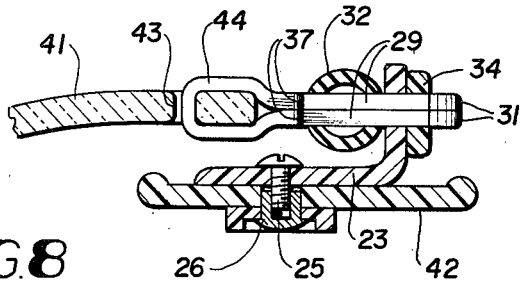
FIG.8

FACE GUARD MOUNT FOR HELMETS

BACKGROUND OF THE INVENTION

A widely recognized and urgent need for safer athletic helmets, such as football and hockey helmets, exists at the present time and has not been satisfied by state of the art developments. Very serious and sometimes life-threatening injuries continue to occur in games such as football due to shocks transmitted directly by the steel face guard to the rigid shell of the player's helmet. Brain concussion and spinal column injuries can result. Similar problems exist with hockey helmets, motorcycle helmets and the like.

Furthermore, when the connections between the face guard and helmet shell are rigid, or nearly rigid, stresses on the face guard are transferred directly to the helmet shell and can deform it, sometimes permanently, and can also crack the helmet shell which again can result in an injury to the athlete wearing the helmet.

It is also possible with state of the art helmets for the steel face guard to separate under impact from the helmet shell to which it is anchored by relatively rigid or unyielding means, and such separation creates an obviously dangerous situation.

To a very limited extent, some structures have been devised in the prior art attempting to deal with the above deficiencies and problems, but as yet nothing even approaching an adequate solution has been offered.

For example, in prior U.S. Pat. No. 3,263,236 to Humphrey an improved connection or mounting for the face guard of a football helmet is disclosed which lessens to some degree the stress transmitted by the guard to the helmet shell and the shock transmitted to the shell when the guard receives a heavy blow. In the structures disclosed in this patent, however, the shock absorbing ability of the face guard mounting is derived entirely from the resiliency of the material from which the guard attaching or anchoring element is formed, such as a solid elastomer. There is no provision in the patented structure for any substantial displacement of the face guard relative to the helmet shell when the guard receives an impact blow. Consequently, the face guard mounting is not very effective in isolating the helmet shell and the head of the wearer from severe shocks, as is accomplished quite effectively with the present invention, in accordance with its main objective.

Additional U.S. Patents to Humphrey, namely, U.S. Pat. Nos. 3,139,624; 3,729,746 and 4,086,664, possess a similar lack of shock absorbing capability, even though they do show improved connecting means between the face guard and helmet shell which resist separation of the guard from the shell and render it possible to raise the guard upwardly and way from the face of the wearer in emergency situations.

In contrast to the devices in the above-noted patents and in any known prior art, the present invention provides a simplified, economical, safe and highly efficient shock absorbing connector or mount between the rigid face guard and the rigid shell of an athletic helmet which isolates the shell and therefore the head of the wearer from severe shocks resulting from impact blows delivered to the face guard. Without loss of anchoring ability, the mount of a face guard can yield under impact to allow substantial and sufficient relative movement between the face guard and helmet shell to effectively absorb the shock. The mount is constructed from components which exhibit a controlled plunger-like movement under shock forces which in turn permits controlled displacement of the face guard relative to the helmet shell followed by controlled return of the guard to its normal position after the shock forces have been dissipated and without permanently deforming or damaging the helmet shell. The components of the mount by their nature can be designed to vary the extent of face guard displacement in accordance with variations in forces against the face guard.

The shock absorbing face guard mount for helmets according to the invention possesses versatility in that it can be installed in various positions on the helmet shell to absorb shocks transmitted in different directions, such as generally horizontally or generally vertically relative to the head of the wearer of the helmet.

Other features and advantages of the invention will become apparent during the course of the following detailed description.

BRIEF DESCRIPTION OF THE DRAWINGS

FIG. 5 is an enlarged fragmentary cross section through the mount and associated elements taken on line 5—5 of FIG. 1.

FIG. 6 is a similar view depicting the operation of the face guard mount under an impact force.

FIG. 7 is a view similar to FIG. 1 showing the invention applied to a hockey helmet.

FIG. 8 is an enlarged horizontal section taken on line 8—8 of FIG. 7.

DETAILED DESCRIPTION

Figure 1:
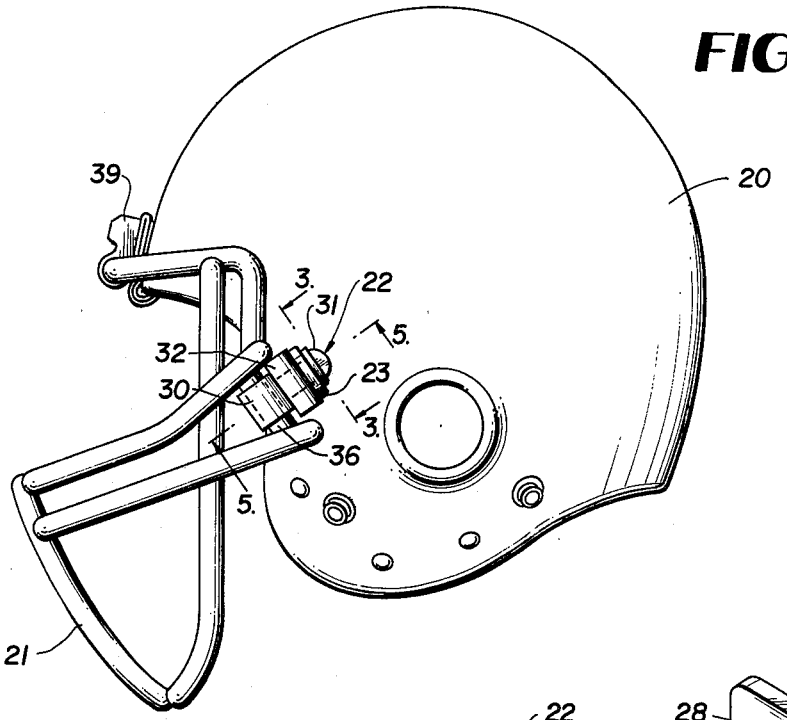
FIG. 1 is a side elevation of an athletic helmet face guard mount according to the invention.
Figure 2:
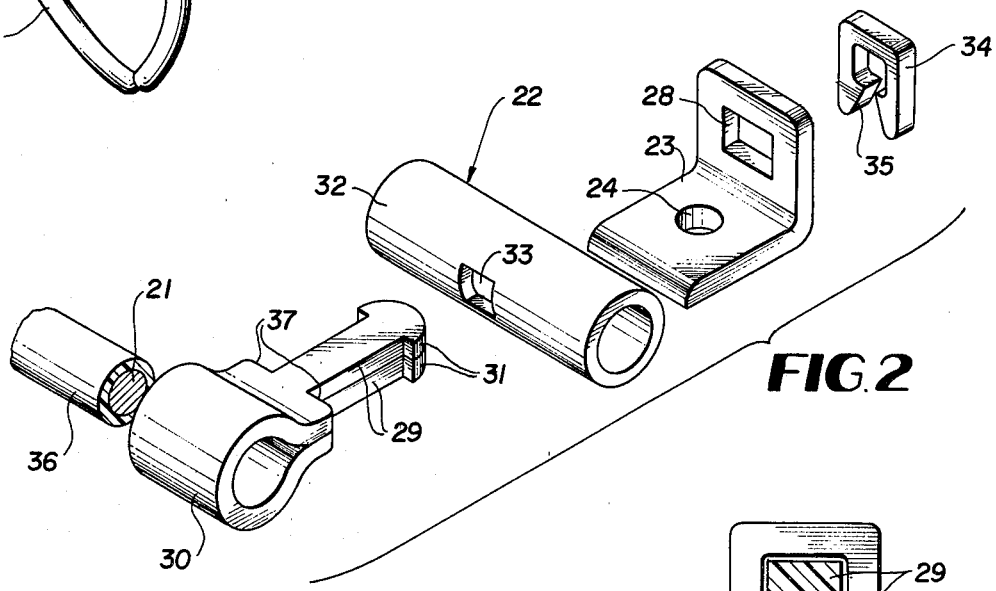
FIG. 2 is an enlarged exploded perspective view of the mount.
Figure 3:
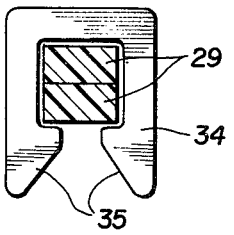
FIG. 3 is an enlarged cross section through the mount taken on line 3—3 of FIG. 1.
Figure 4:
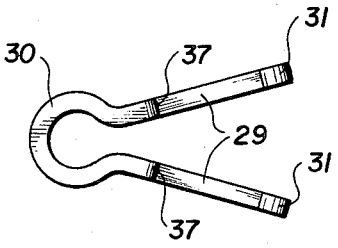
FIG. 4 is an elevational view of a connecting strap element in a relaxed state.

Referring to the drawings in detail wherein like numerals designate like parts, there is shown in FIGS. 1 through 6 a football helmet having the customary substantially rigid exterior shell 20 to which the usual rigid face guard 21 is attached through the shock absorbing mount 22 forming the main subject matter of this invention.

The shock absorbing mount 22 comprises an L-shaped anchor bracket 23 formed of molded nylon or like tough material and having a circular aperture 24 in its base web receiving an anchor screw 25 engaging through a T-nut 26, held within a grommet 27, inserted in a provided opening in the helmet shell 20, FIGS. 5 and 6. The other web of the anchor bracket 23 extends outwardly from the helmet shell and has a preferably rectangular aperture 28 formed therethrough adapted to receive two extension arms 29 of a strap element 30 formed of tough nylon or similar strong material. The arm extensions 29 have retainer heads 31 on their leading ends.

The shock absorbing mount further comprises a short length of cylindrical resilient tubing 32, such as polyurethane tubing, capable of serving as a shock absorbing spring element. At its longitudinal center, the tubing section has a transverse rectangular through opening 33 adapted to receive the extension arms 29, and through which the retaining heads 31 can be inserted.

The mount further includes a resilient clip 34 also formed of tough nylon or equivalent material and having beveled entrance faces 35 which can be cammed over the arms 29 when the latter are in parallel contacting relationship, the clip then engaging behind the retainer heads 31, as clearly shown in FIGS. 5 and 6.

The strap element 30, when its arms 29 are drawn together into parallelism, assumes a substantially cylindrical form and can embrace a rod portion 36 of the face guard 21, as shown in FIG. 1. In this position, the strap element 30 becomes quite rigid and can embrace the rod portion 36 of the guard tightly to support it in assembled relationship with the helmet shell.

The resilient tubing element 32 is held captive in the shock absorbing mount between the outwardly projecting web of anchor bracket 23 and shoulder formations 37 which exist on the strap element 30 on opposite sides of the extension arms 29. These arms preferably have a somewhat loose fit within the rectangular aperture 28.

When the cylindrical tubing section 32 is relaxed, FIG. 5, as when there is no impact force on the face guard 21, its opposite sides are very close to or in light contact with shoulders 37 and the opposing outstanding web of bracket 23. As shown in FIG. 6, when the face guard 21 receives an impact blow indicated by the arrow 38, the tubing section 32 can yield to the required extent to absorb the shock of this blow, and in some cases will assume a completely flattened configuration against the outstanding web of bracket 23. The arms 29 at this time will move through the aperture 28 and with the clip 34 will be displaced well beyond the far side of the outstanding bracket web. In practice, the actual displacement allowed by the collapsing tubing section 32 can be ⅜ths of an inch more-or-less depending upon the relative sizes of the components of the shock absorbing mount.

When the mount moving in this manner with the connected portion 36 of the face guard has sufficiently absorbed the shock force generated by the impact blow, its components will return automatically to their relative positions of FIG. 5 as a result of the memory of the resilient tubing section.

In addition to forming an effective shock absorber, the mounting is entirely free of sharp edges or exposed metal parts which could injure the helmet wearer or another person. The cylindrical spring form provided by tubing section 32 is ideal from this safety standpoint, although in some cases alternate spring forms might be employed, such as wavy spring elements or solid rod-type elements formed of foam elastomer.

The shock absorbing mount 22 in addition to providing for positive significant displacement of the face guard along the longitudinal axis of arms 29 under impact forces with a plunger-type operation also allows some lateral displacement or floating action of the face guard relative to the helmet shell 20 across the axis of the arms 29 due to some inherent resiliency of the attaching loop element 30. Therefore, the mounting can absorb shocks in multiple directions to a significant degree. This ability prevents distorting and cracking of the rigid helmet shell resulting from face guard impact.

While the mount 22 is shown on the helmet in FIG. 1 in a certain inclined side position to accommodate the particular angle of the guard portion 36, it will be appreciated that the mount can be installed in any required location on the helmet to resist and absorb shock forces directed along any axis. In the FIG. 1 illustration, the top mount 39 for the face guard is a conventional prior art mount. In some cases, the shock absorbing mount 22 can also be used as a top mount for the face guard to absorb shocks in a vertical plane.

Another benefit of the mount 22 is that in emergency situations as where an athlete may have a serious head or neck injury requiring removal of the helmet with great care, the retainer clip 34 can be easily removed so that the loop element 30 can be separated quickly from the bracket 23. This will release the face guard 21 so that it can be rotated upwardly away from the face and toward the top of the head.

FIGS. 7 and 8 show the invention applied to a typical hockey helmet 40 having a face guard 41 and side depending shell extensions 42. The guard 41 at each side thereof can have a short vertical slot 43 receiving an attaching loop element 44 substantially identical to the described loop element 30 and having the arms 29, retainer heads 31 and shoulder formations 37. The same retainer clip 34 and resilient tubing section 32 previously described are employed and function in the same manner. The anchor bracket 23 is secured by the screw 25 and T-nut 26 to the adjacent shell extension 42, FIG. 8.

The invention is applicable to other types of helmets including motorcycle helmets. Its numerous advantages of the prior art should now be fully apparent to those skilled in the art.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a helmet, a substantially rigid helmet shell, a substantially rigid face guard for the helmet, and a yielding shock absorbing mount for the face guard including an anchor element attached to the shell, a connecting element attached to the face guard and having an extension portion engaged movably with the anchor element, and a resilient shock absorbing element engaged between parts of the anchor and connecting elements and yieldingly resisting movement of the connecting element in one direction relative to the anchor element in response to an impact force on the face guard.

2. In a helmet as defined in claim 1, and the connecting element being adapted to yield across the path of movement of the connecting element with respect to the anchor element.

3. In a helmet as defined in claim 1, and the anchor element comprising a bracket having a wall projecting outwardly from said shell and said wall having an aperture, said extension portion adapted to reciprocate within said aperture, and means to retain the connecting element engaged movably with said anchor element.

4. A shock absorbing mount for a helmet face guard comprising a first attaching element adapted for mounting on a helmet shell, a second attaching element adapted for mounting on a helmet face guard and having an extension portion movably engaged with the first attaching element for plunger-like reciprocation relative thereto, and a shock absorbing resilient element held between opposing surfaces of the first and second attaching elements.

5. In a helmet, a substantially rigid helmet shell, a substantially rigid face guard for the helmet, and a yielding shock absorbing mount for the face guard including an anchor element attached to the shell, said anchor element comprising a bracket having a wall projecting outwardly from said shell and said wall having an aperture, a connecting element attached to the face guard and having a shank portion engaged movably with the anchor element and, adapted to reciprocate within said aperture, a head carried by the shank portion, a clip detachably engageable with the shank portion between said head and said wall to retain the connecting element engaged movably with said anchor element, and a resilient shock absorbing element engaged between parts of the anchor and connecting elements and yieldingly resisting movement of the connecting element in one direction relative to the anchor element in response to an impact force on the face guard.

6. In a helmet, a substantially rigid helmet shell, a substantially rigid face guard for the helmet, and a yielding shock absorbing mount for the face guard including an anchor element attached to the shell, said anchor element comprising a bracket having a wall projecting outwardly from said shell and said wall having an aperture, a connecting element attached to the face guard and having a shank portion engaged movably with the anchor element and, adapted to reciprocate within said aperture, means to retain the connecting element engaged movably with said anchor element, and a resilient shock absorbing element comprising a tubing section of resilient material disposed between said wall and a shoulder of the connecting element across the axis of said shank and having a transverse through passage receiving said shank movably and yieldingly resisting movement of the connecting element in one direction relative to the anchor element in response to an impact force on the face guard.

7. A shock absorbing mount for a helmet face guard comprising a first attaching element adapted for mounting on a helmet shell, a second attaching element adapted for mounting on a helmet face guard and being movably engaged with the first attaching element for plunger-like reciprocation relative thereto, and a shock absorbing resilient element comprising a tube section held between opposing surfaces of the first and second attaching elements and having its longitudinal axis across the axis of movement of the second attaching element.

8. A shock absorbing mount for a helmet face guard as defined in claim 7, and the first attaching element including a wall portion extending outwardly of a helmet shell on which the first attaching element is mounted, the second attaching element having a shoulder in spaced opposed relationship to said wall portion and said tube section being held between said shoulder and wall portion and collapsing yieldingly when the shoulder moves toward the wall portion.

9. A shock absorbing mount for a helmet face guard as defined in claim 8, and the second attaching element comprising a strap adapted to embrace a bar of the face guard and including extensions forming a reciprocatory shank, said wall portion having an opening receiving said shank for plunger-like movement therein, and said tube section having a transverse through passage receiving said shank.

10. A shock absorbing mount for a helmet face guard as defined in claim 9, and means connecting said shank releasably with said wall portion.

11. A shock absorbing mount for a helmet face guard comprising a first attaching element adapted for mounting on a helmet shell, a second attaching element adapted for mounting on a helmet face guard and being movably engaged with the first attaching element for plunger-like reciprocation relative thereto, and a shock absorbing resilient element comprising a tubing section of resilient material held between opposing surfaces of the first and second attaching elements.

12. A shock absorbing mount for a helmet face guard as defined in claim 11, and said tubing section having a transverse through passage receiving said second attaching element.

13. A shock absorbing mount for a helmet face guard comprising a first attaching element adapted for mounting on a helmet shell, a second attaching element adapted for mounting on a helmet face guard and being movably engaged with the first attaching element for plunger-like reciprocation relative thereto, and a shock absorbing resilient element held between opposing surfaces of the first and second attaching elements and having a transverse through passage receiving said second attaching element.

14. In a helmet, a substantially rigid helmet shell, a substantially rigid face guard for the helmet, and a yielding shock absorbing mount for the face guard including an anchor element attached to the shell, a connecting element attached to the face guard and being engaged movably with the anchor element, and a resilient shock absorbing element comprising a tubing section of resilient material engaged between parts of the anchor and connecting elements and yieldingly resisting movement of the connecting element in one direction relative to the anchor element in response to an impact force on the face guard.

15. In a helmet, a substantially rigid helmet shell, a substantially rigid face guard for the helmet, and a yielding shock absorbing mount for the face guard including an anchor element attached to the shell, a connecting element attached to the face guard and being engaged movably with the anchor element, and a resilient shock absorbing element engaged between parts of the anchor and connecting elements and having a transverse through passage receiving said connecting element and yieldingly resisting movement of the connecting element in one direction relative to the anchor element in response to an impact force on the face guard.

* * * * *